US005961119A

United States Patent [19]

Brown

[11] Patent Number: 5,961,119

[45] **Date of Patent: *Oct. 5, 1999**

[54] CRAPS GAME QUALIFIED BY ANOTHER GAME OF CHANCE

[75] Inventor: J. Breck Brown, Las Vegas, Nev.

[73] Assignee: Steven R. Pyykkonen, Leonard, Mich.; a part interest

[ * ] Notice: This patent is subject to a terminal disclaimer.

[21] Appl. No.: 08/985,729

[22] Filed: Dec. 5, 1997

Related U.S. Application Data

[63] Continuation of application No. 08/724,597, Sep. 30, 1996, which is a continuation-in-part of application No. 08/587,016, Jan. 16, 1996, abandoned, which is a continuation-in-part of application No. 08/533,567, Sep. 25, 1995, abandoned.

[51] Int. Cl.[6] ..... A63F 1/00

[52] U.S. Cl. ..... 273/292; 273/274

[58] Field of Search ..... 273/274, 292, 273/243, 148 R, 309

[56] References Cited

U.S. PATENT DOCUMENTS

| | | |
|---|---|---|
| 4,443,012 | 4/1984 | Makovic et al. . |
| 4,515,369 | 5/1985 | Johnson . |
| 4,746,126 | 5/1988 | Angileri . |
| 5,377,973 | 1/1995 | Jones et al. . |
| 5,393,067 | 2/1995 | Paulsen et al. . |
| 5,472,194 | 12/1995 | Breeding et al. . |

*Primary Examiner*—William M. Pierce
*Attorney, Agent, or Firm*—Howard & Howard

[57] ABSTRACT

A method and game board are disclosed for combining the play of blackjack based upon at least one card deck having fifty-two cards divided into four suites of duces through aces and the play of craps based upon two dice each having six faces numbered one to six. The board presents a semi-circular playing arena with a dealer playing area adjacent the straight diameter of the semi-circular playing arena and a plurality of player areas spaced about the circumference of the circular periphery of said semi-circular playing arena and opposed to the dealer playing area. Each of the player areas includes a plurality of craps wager indicator circles dividing the numbers 2 through 12 into three groups for wagering at different odds for each group. After the wagers are settled based upon the play of the cards in accordance with the rules of blackjack, each player who has a blackjack is offered the roll of the dice and a craps wager on one of the craps wager circles. Before rolling the dice, the remaining players may also place bets on one of their respective craps wager circles. Each craps wager is then settled based the outcome of the single roll of the dice by the player having the blackjack. The subject invention is characterized by interleaving an accumulating pot which is supported by each player placing a pot wager on one of the three wager indicator circles prior to the cards being dealt. A register keeps track of these initial pot wagers until the hand is complete. The pot accumulates from hand to hand until a player qualifies and wins at least a portion of the accumulated pot. A player qualifies to roll the dice for a portion of the pot by having a predetermined blackjack, such as the Ace and Jack of one suit or different suits. The pot is divided into three portions correlating to the odds in the respective wager indicator circles and the qualified player wins one of those portions when his initial pot wager is on the wager indicator circle having the group of numbers covering, i.e., matching, the numbers on his roll of the dice.

5 Claims, 2 Drawing Sheets

CRAPS GAME QUALIFIED BY ANOTHER GAME OF CHANCE

RELATED APPLICATION

This application is a continuation of application Ser. No. 08/724,597 filed Sep. 30, 1996 which is a Continuation-In-Part of application Ser. No. 08/587,016 filed Jan., 16, 1996, now abandoned, and which is a Continuation-In-Part of application Ser. No. 08/533,567 filed Sep. 25, 1995, now abandoned.

TECHNICAL FIELD

The subject invention relates to a combination card and dice game.

BACKGROUND ART

Various games are known in the prior art which combine standard playing cards and two dice. The U.S. Pat. No. 4,746,126 to Angileri discloses a game utilizing the attributes of CRAPS with the play of cards wherein the play of the cards is dependent upon the throw of the dice. The U.S. Pat. No. 4.515,369 discloses a game combining the elements of Craps and blackjack wherein the rules of blackjack apply to movement of game pieces as determined by the roll of the dice.

Against this prior art background, the invention of combining the play of the card game of twenty-one, or blackjack, and the dice game of Craps was made and is disclosed and claimed in the abovementioned application Ser. No. 08/533, 567 filed Sep. 25, 1995. In accordance with that invention, at least two cards are presented to each player under the rules of blackjack and a Craps wager is offered to all of the players when at least one player has two cards equaling twenty-one. The Craps wagers are settled based upon wagers made by the individual players and the roll of the dice generally in accordance with the odds and the rules of Craps.

SUMMARY OF THE INVENTION

A method of combining the play of twenty-one and Craps comprising the steps of offering an accumulative pot wager based upon the roll of two dice prior to presenting the cards to the players, presenting at least two cards to each player, accumulating the pot wagers without payout until a qualified player has two cards of a predetermined combination to make a predetermined blackjack equaling twenty-one, rolling the dice by the qualified player, and paying out a portion of the accumulated pot to the qualified player in response to the pot wager by the qualified player covering or matching the outcome of the roll of the dice.

A device for combining the play of twenty-one based upon at least one card deck having fifty-two cards divided into four suites of duces through aces and the play of Craps based upon two dice each having six faces numbered one to six. The device includes a dealer presentation area for presenting the dealer's cards, a player presentation area for each player to present the player cards, and a plurality of Craps wager indicators for each player presentation area. The device is characterized by register means for indicating an accumulated pot wager for each player placed upon the Craps wager indicators and posting means for posting the payout of the accumulated pot from hand to hand.

BRIEF DESCRIPTION OF THE DRAWINGS

Other advantages of the present invention will become readily appreciated as the same becomes better understood by reference to the following detailed description when considered in connection with the accompanying drawings wherein FIG. 1 discloses a game board illustrating the subject invention

DETAILED DESCRIPTION OF PREFERRED EMBODIMENT

Figure 1:
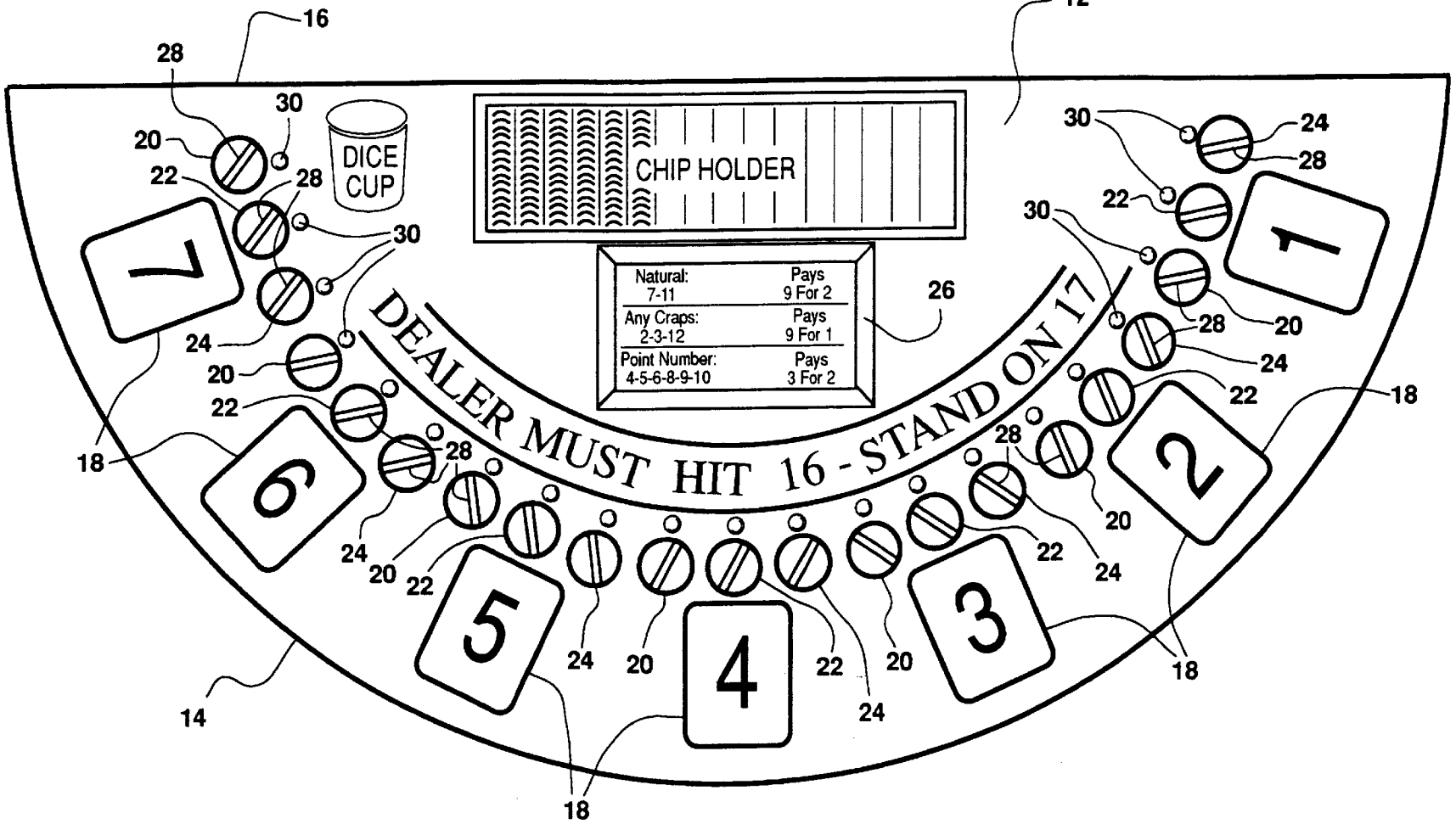
Figure 2:
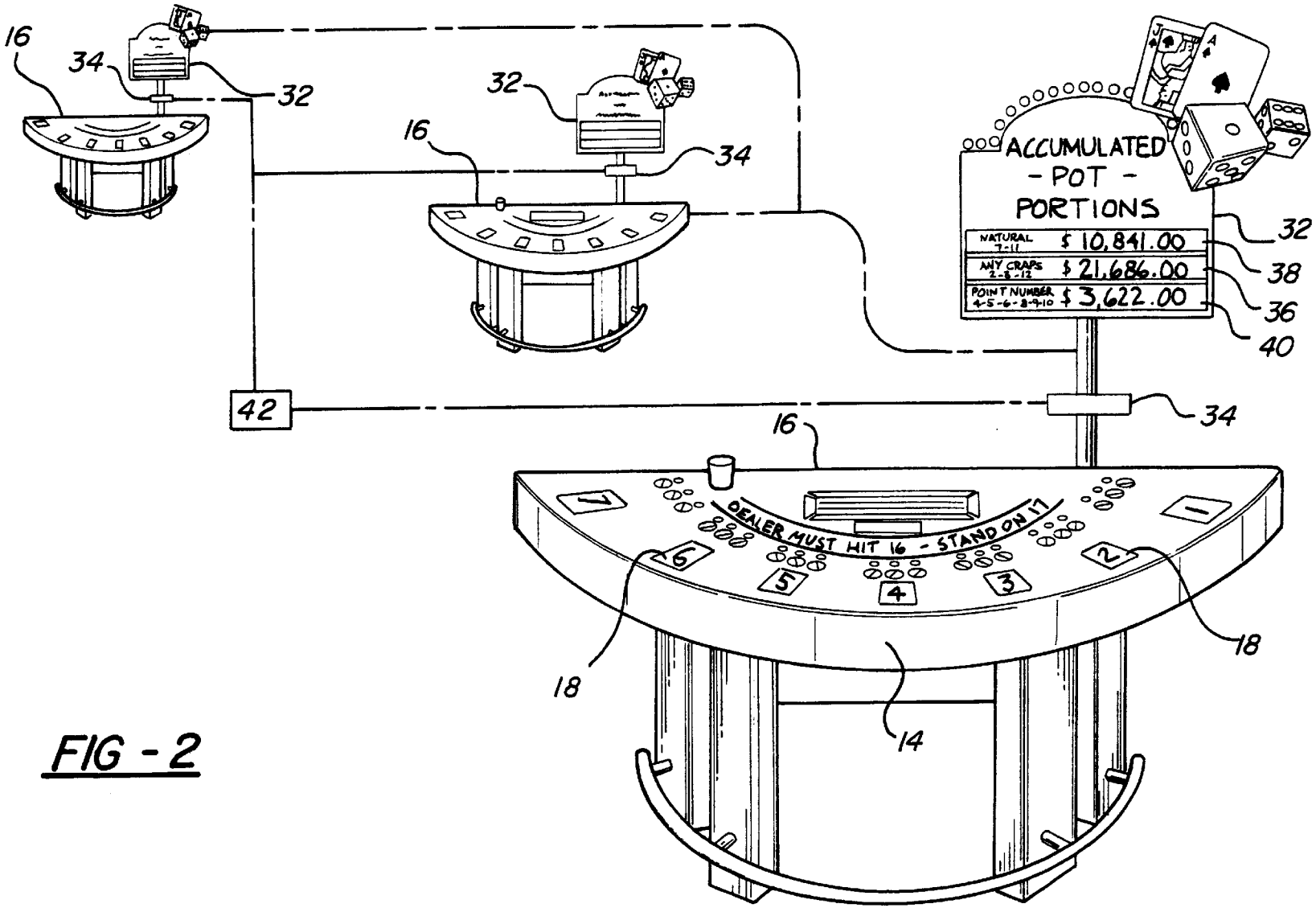
FIG. 2 shows a plurality of playing tables networked together.

An amusement device for combining the play of twenty-one and Craps is generally shown in FIG. 1. The device takes the form of a mat, table cloth or cover, place mat, or the like, and may even be implemented in a computer program producing images for a monitor, or a machine making the same presentations. In any case the device comprises a presenter for positioning at least two cards for each player and a Craps wager indicator for each player to indicate the Craps wager based upon the roll of two dice by each player having only two cards equaling twenty-one.

As illustrated, the device is a game board or cover for combining the play of twenty-one based upon at least one card deck having fifty-two cards divided into four suites of duces through aces and the play of Craps based upon two dice each having six faces numbered one to six. The board or cloth comprises an upper playing surface 12 which presents a semi-circular or arcuate playing arena, defined by the semi-circle 14 and the straight diameter 16. A dealer playing area is disposed in the middle adjacent the straight diameter 16 of the semi-circular playing arena. More specifically, the dealer playing area is in the area indicated by the indicia portraying the chip holder and chips. This is a dealer presentation area for presenting, i.e., depositing, the dealer's cards.

The board also defines a plurality of player areas spaced about the circumference of the circular periphery 14 of the semi-circular playing arena and opposed to the dealer playing area. Each of the player areas comprises a rectangular card box 18 defining a player presentation area for each player to present or deposit the player cards. This box may be defined by a space or a multitude of indicia instead of or in addition to the cards and dice shown, as for example, an Ace and Jack of spades in an array with two dice. A plurality of Craps wager indicator areas 20, 22 and 24 are disposed adjacent each player area 18 to divide the numbers 2 through 12 into a plurality of groups for wagering at different odds for each group. More specifically, a plurality of three Craps wager indicator areas 20, 22 and 24 are presented for each player with each indicator area presenting different odds for different total dice numbers. A first of the indicators, i.e., indicator area 20, presents the numerals 7 and 11 for first odds of nine for two, a second indicator area 22 presents the numerals 2, 3 and 12 for second odds of nine for one, and a third indicator area 24 presents the remaining numbers for third odds of three for two.

The game board 10 presents an odds area 26 centrally located and indicating the first, second and third odds for the respective wager indicator areas 20, 22 and 24. That is, the first table pay-off odds are nine chips for two chips bet on a natural 7 or 11; the second table pay-off odds are nine chips for one chip bet on Craps 2, 3 or 12; and the third table pay-off odds are three chips for two chips bet on the point numbers 4,5,6,8, 9 or 10. The first true odds are three and one half to one for a natural 7 or 11, the second true odds are eight to one for Craps 2, 3 or 12, and the third true odds are one to two for point numbers 4, 5, 6, 8, 9 or 10. The board may include other informative indicia like the dealer must take a card when at sixteen and stand at seventeen in blackjack.

The play of twenty-one, i.e., blackjack, and Craps is combined in the basic steps of presenting at least two cards to each player followed by then offering a Craps wager based upon the roll of two dice to a player having two cards equaling twenty-one, i.e., to each player having a blackjack. Each player having blackjack then places a Craps wager and rolls the dice, alternatively, to qualify to roll the dice the player, in addition to having a blackjack, must also beat the dealer. The wagers are then settled based upon the outcome of the roll of the dice. The offering of the Craps wager includes the offer of a plurality of alternative dice number combinations in groups having different betting odds. More specifically, the offering of the wager combinations are divided into the dice number combinations of the natural 7 or 11 at first odds, the dice number combinations of any Craps 2, 3 or 12 at second odds, and the remaining dice number combinations of the point numbers 4, 5, 6, 8, 9, or 10 at different third odds. For example, the numerals 7 and 11 may be at first odds of nine for two, the numerals 2, 3 and 12 may be at second odds of nine for one, and the remaining numbers of 4, 5, 6, 8, 9, and 10 may be at third odds of three for two. Of course, these odds may vary as in accordance with individual house rules. These three groups of numbers are respectively presented in the first, second and third indicator areas 20, 22 and 24 respectively for each player.

The play of twenty-one is based upon at least one card deck having fifty-two cards divided into four suites of duces through aces and the play of Craps based upon two dice each having six faces numbered one to six. It involves the placing of a blackjack wager n behalf of each player to beat a dealer player by placing chips in front of the card boxes 18. The dealer, or machine, presents two cards to each player including the dealer player by placing the cards on the card boxes 18 in sequence about the semi-circle 14. As is normal in the game of blackjack, additional cards are sequentially presented to each player in response to a request for same from that player. Thereafter, the blackjack wagers are paid or settled in the absence of requests for additional cards.

The opportunity or option to roll two dice is then presented to each player having a blackjack consisting of only two cards equaling twenty-one. However, before the roll of the dice, each player establishes a Craps wager, if the player wishes to participate, based upon the roll of the two dice by placing chips on one of the three circles 20, 22 and 24 to indicate the numbers and odds of the roll. The blackjack winner then rolls the dice once and each Craps wager by each player is settled based the outcome of the roll of the dice by the blackjack winner.

The subject invention provides an accumulated pot variation which may be combined with or substituted for the wager entitlement which occurs upon a player having two cards equaling twenty-one. In either case, the two are completely independent as the wagers on the accumulated pot are accumulated separately and paid out on independent criteria. However, in the preferred embodiment, the accumulated pot is played along with or in conjunction with the Craps wager entitlement.

More specifically, the accumulated pot variation is played by offering an accumulative pot wager based upon the roll of two dice prior to presenting the cards to the players. In other words, the entire game is initiated by each player placing a pot wager on one or more of the Craps wager indicator areas 20, 22 and 24. The system will include a register for indicating the pot wager placed by each player upon the Craps wager indicator areas 20, 22 and 24, i.e., the register will indicate the one of the three Craps wager indicator areas 20, 22 and 24 upon or into which each player has placed a pot wager. Each wager indicator area 20, 22 and 24 could have a slot 28 for receiving and electronically counting the chip wagered on the pot with an indicator light 30 to indicate the area wagered.

The game proceeds as described above with the Craps wager indicator areas 20, 22 and 24 used by the players to place wagers in the event one of the players gets twenty-one. Successive hands are dealt and played while accumulating the pot wagers without payout until a player becomes a qualified player by having two cards of a predetermined combination to make a predetermined blackjack equaling twenty-one. In other words, when a player receives a predetermined blackjack, e.g., a predetermined combination of an Ace and a Jack of the same suit or different suits, or specifically the Ace of hearts and the Jack of spades, that player becomes a qualified player eligible to win a portion of the accumulated pot.

The qualified player rolls the dice to match his initial pot wager placed at the beginning of the game and which the register light 30 has indicated throughout the play. If the player placed wagers on more than one indicator area, the player rolls the dice once for each different indicator area upon which the player placed a wager. Accordingly, all or at least a portion of the accumulated pot is paid out to the qualified player in response to the registered pot wager by the qualified player covering the outcome of the roll of the dice. That is, the accumulated pot is paid to the player if the roll of the dice for a certain indicator area matches any of the numbers in that indicator area. The accumulated pot is divided into three different payout portions each corresponding to one of the Craps wager indicator areas 20, 22 and 24. Hence, the pot wager is made on the dice number combinations of 2, 3 and 12 at the greatest payout portion and dice number combinations of 7 and 11 at a lesser payout portion and the remaining dice number combinations at the smallest payout portion. There is also included a posting means comprising a sign for posting the respective greatest, lesser and smallest payout portions. As the pot grows from hand to hand a counter calculates the respective payouts and the amounts continually change on the electronic sign.

To further enhance the game by increasing the accumulated pot faster and to higher amounts, a plurality of playing sites, i.e., individual tables each with its own dealer, may be combined electronically to establish one common combined pot. This common combined pot is divided into three portions, each of which is paid out to the first player having the winning combination of a predetermined blackjack and rolling the dice to match his registered pot wager. Otherwise, the pot wagers are accumulated without payout from hand to hand until a qualified Craps player has the predetermined winning combination. The pot wagers placed on the respective wager indicator areas 20, 22 and 24 may be accumulated separately, i.e., individually, to establish independent posted portions on the electronic signs 32 which may vary from time to time in proportion to the number of wagers in each wager indicator area 20, 22 and 24 and/or the lack of winning players in one or two pot portions. After a win, that portion of the pot may be seeded to start a new series of hands.

Accordingly, at one seating a player may play blackjack and qualify to further bet on a Craps roll of the dice each time the player receives a blackjack, and, in addition, to place pot wagers to qualify for rolling the dice for the pot in the event of receiving a predetermined blackjack, such as the Ace and Jack of one designated combination. Alternatively, the invention may interleave the pot wager with similar card games which are played from hand to hand under conventional rules until a player qualifies to roll the dice for at least a portion of the pot by beating the dealer in the card game with a predetermined combination of cards which is generally more difficult to acquire than lesser winning combinations and then follows up with a roll of the dice producing numbers in the group of numbers the player wagered upon in the pot wager at the beginning of the hand.

In the preferred sequence of play, a first accumulative pot wager is offered to each player at a first group 20 of numbers at first odds based upon the roll of two dice. At the same time, second and third accumulative pot wagers are offered to each player at respective second and third groups 22 and 24 of numbers at second and third odds based upon the roll of two dice. Each player places a blackjack wager on behalf to beat a dealer player at blackjack in accordance with the normal rules of blackjack. The dealer or machine then presents two cards to each player including the dealer player to begin a hand. At this point, if no player has a blackjack, the first accumulative pot wagers are accumulated in a first accumulative pot without payout from card game to card game until a qualified pot player has cards of a predetermined combination equaling twenty-one, i.e., a blackjack, and makes a winning roll of the dice. Likewise, the second and third accumulative pot wagers are accumulated in a second accumulative pot and in a third accumulative pot respectively without payout from card game to card game until being won by a winning qualified pot player having cards of a predetermined combination equaling twenty-one, i.e., a blackjack, and makes a winning roll of the dice. As the respective accumulated pots increase from hand to hand because no player becomes a winning qualified pot player, or, if so, does not roll a number on the dice which matches a number in the indicator area upon which that player placed an accumulative pot wager, a posting means 32 posts the payout of the first accumulated pot to the winning qualified player in response to the numbers resulting from the roll of the dice by the winning qualified player matching one of the numbers in the first indicator area 20 upon which the winning qualified player placed a first accumulative pot wager and for posting the payout of the second accumulated pot to the winning qualified player in response to the numbers resulting from the roll of the dice by the winning qualified matching one of the numbers in said second indicator area 22 upon which the winning qualified player placed a second accumulative pot wager and for posting the payout of the third accumulated pot to the winning qualified player in response to the numbers resulting from the roll of the dice by the winning qualified matching one of the numbers in said third indicator area 24 upon which the winning qualified player placed a third accumulative pot wager. The posting means 32 includes a computer and counter to keep track of the wagers on the respective indicator areas 20, 22 and 24.

However, if a player has a predetermined combination of cards, such as the Ace of hearts and the Jack of spades, the player becomes a qualified pot player and is entitled to the roll of two dice for the accumulated pot upon which the player placed a wager, i.e., one or more of the wager indicator areas 20, 22 and/or 24, at the onset of the game. Accordingly, either a dealer or a machine presents a roll of the two dice to the qualified pot player having the predetermined combination of cards for a wager placed by the qualified pot player on the first group 20, i.e., first indicator area 20. Sequentially, that same qualified player having the predetermined combination of cards is presented a roll of the two dice for a wager placed by that qualified pot player on the second group, i.e., indicator area 22. And thereafter, that same qualified player having the predetermined combination of cards is presented a roll of the two dice for a wager placed by that qualified pot player on the third group, i.e., indicator area 24. Instead of actual dice, the roll of the dice could be accomplished by the dealing of cards having dice numbers or by a computer or a machine. Only the player having the predetermined combination of cards is allowed to roll the dice for the accumulated pot and then only for the accumulated pot upon which that player placed a wager at the onset of the hand. If the qualified player placed a wager on more than one of the indicator areas 20, 22 and 24, that qualified player is presented the a roll of the dice for each indicator area, i.e., each accumulative pot, upon which that player initially placed a an accumulative pot wager. The initial accumulative pot wagers by all of the other players are cleared and placed into the accumulative pot as posted by the posting means or sign 32. Accordingly, just before the pot player rolls the dice for the accumulated pot or pots, the wager indicator areas 20, 22 and 24 are cleared with the wagers going to the respective accumulated pots with a corresponding increase in the value posted by the posting means 32 for the respective pots.

If upon the rolling the two dice by the qualified Craps player, the numbers on the dice match one of the numbers in the indicator area 20, 22 or 24 for which the dice were rolled, then the accumulated pot as indicated on the posting means 32 is paid out to the player. In other words, if the qualified player is rolling the dice for a wager placed upon the first indicator area 20, i.e., the first accumulative pot, at least a portion of the first accumulated pot is paid out to the winning qualified player in response to the numbers resulting from the roll of the dice matching one of the numbers in the first group of numbers set forth in the first indicator area 20. In a similar fashion, if the qualified player is rolling the dice for a wager placed upon the second indicator area 22, i.e., the second accumulative pot, at least a portion of the second accumulated pot is paid out to that winning qualified player in response to the numbers resulting from the roll of the dice matching one of the numbers in the second group of numbers set forth in the second indicator area 22. The same occurs if the qualified player is rolling the dice for a wager placed upon the third indicator area 24, i.e., the third accumulative pot, at least a portion of the third accumulated pot is paid out to that winning qualified player in response to the numbers resulting from the roll of the dice matching one of the numbers in the third group of numbers set forth in the third indicator area 22.

In the absence of a player having the predetermined combination of cards to qualify to roll the dice for one or more accumulative pots, or after that qualified player has rolled the dice for the accumulative pot or pots, each player having two cards equaling twenty-one is identified as a natural blackjack player. This includes the player having the predetermined combination because that is also a natural blackjack. For each player having a natural blackjack, a craps wager is presented, i.e., offered, to each player on one of the first, second and third groups of numbers. Said another way, each player may place a wager on one of the indicator areas 20, 22 or 24 in front of the player, but only one of the areas for one set of odds. After all bets are placed on the respective indicator areas 20, 22 or 24, a roll of the two dice is presented to the natural blackjack player who then rolls the dice. Each player is then paid the designated odds in response to the numbers resulting from the roll of the dice by the natural blackjack player matching one of the numbers in the group of numbers upon which that player placed a craps wager. The same sequence is conducted for each natural blackjack.

After all of the opportunities for rolling the dice based upon blackjacks or two card twenty-one are resolved, the normal game of blackjack proceeds by sequentially presenting additional cards to each player in response to a request for same from that player. As is customary in blackjack, the blackjack wagers are paid in the absence of requests for additional cards and the hand comes to an end, ready to start over with a new deal. As will be appreciated, the various steps, order of play or sequence of play may be varied without departing form the inventive combination.

As alluded to above, the method is further defined as offering 2, 3 or 12 as the first group of numbers at the first payout odds and offering 7 and 11 as the second group of numbers at the second payout odds and offering the remaining dice number combinations as a third group at third payout odds.

A further refinement includes the steps of combining the play of at a plurality of independent playing sites with a dealer at each site by combining the first accumulated pot from the plurality of independent playing sites and paying out at least a portion of the combined first accumulated pot to the winning qualified player as well as similarly independently combining the second and third accumulated pots from the plurality of independent playing sites and paying out at least a portion of the respective combined second and third accumulated pots to the winning qualified player.

Although the gaming device for implementing play may comprise a machine, it frequently employs a gaming table presenting an upper playing surface. A plurality of player areas are spaced about the periphery of the arcuate playing arena and opposed to the dealer playing area. Each of the player areas comprises a card box 18 and a plurality of group indicator areas 20, 22 and 24 dividing the numbers 2 through 12 into a plurality of groups for presenting a first accumulative pot wager to each player at a first indicator area 20 presenting a first group of the numbers at first odds based upon the roll of two dice and for presenting a second accumulative pot wager to each player at a second indicator area 22 presenting a second group of the numbers at second odds based upon the roll of two dice and for presenting a third accumulative pot wager to each player at a third indicator area 24 presenting a third group of the numbers at third odds based upon the roll of two dice.

A first of the registers 30 is included for each player to indicate a first accumulative pot wager placed by each player upon the first indicator area 20. A second of the registers 30 is included for indicating a second accumulative pot wager placed by each player upon the second indicator area 22. Similarly, a third of the registers 30 is included for indicating a third accumulative pot wager placed by each player upon the third indicator area 24.

Each table includes a computerized totalizing device 34 for providing a first accumulation means for adding the first accumulative pot wagers 20 from hand to hand into a first accumulated pot until being won by a winning qualified pot player having cards of a predetermined combination equaling twenty-one. The running summation of that first accumulated pot is posted by a first sign 36 of the posting means 32 for each table. The device 34 also provides a second accumulation means for adding the second accumulative pot wagers 22 from hand to hand into a first accumulated pot until being won by a winning qualified pot player having cards of a predetermined combination equaling twenty-one. The running summation of that second accumulated pot is posted by a sign 38 of the posting means 32 for each table. The device 34 also provides a third accumulation means for adding the third accumulative pot wagers 24 from hand to hand into a first accumulated pot until being won by a winning qualified pot player having cards of a predetermined combination equaling twenty-one. The running summation of that third accumulated pot is posted by a sign 40 of the posting means 32 for each table.

In addition, a networking means 42 may be included for combining the play of at a plurality of independent playing sites or tables with a dealer at each site by combining the first accumulated pot from the plurality of independent playing sites and paying out at least a portion of the combined first accumulated pot to the winning qualified player. In the event the first accumulated pot is combined among a plurality of sites or tables, the first sign 36 at each table will show that combined pot which could be won by a winning qualified player at any one of the networked tables. Of course, the networking means 42 would also independently combine the respective second and third accumulated pots from the plurality of independent playing sites.

As alluded to above, the dice rolling means is included for presenting a roll of the two dice to the winning qualified pot player for a wager placed by the winning qualified pot player on the first indicator area 20 and for presenting a roll of the two dice to the winning qualified pot player for a wager placed by the winning qualified pot player on the second indicator area 22 and for presenting a roll of the two dice to the winning qualified pot player for a wager placed by the winning qualified pot player on the third indicator area 24. This dice rolling means could be a cup, a closed and clear walled container for rolling the dice within the container, or cards having a dice number on each of at least twelve cards, or a computerized or mechanized device for randomly selecting the dice number.

The invention has been described in an illustrative manner, and it is to be understood that the terminology which has been used is intended to be in the nature of words of description rather than of limitation. Obviously, many modifications and variations of the present invention are possible in light of the above teachings. It is, therefore, to be understood that within the scope of the appended claims, wherein reference numerals are merely for convenience and are not to be in any way limiting, the invention may be practiced otherwise than as specifically described.

What is claimed:

1. A method of combining the play of a game of chance and craps based upon two dice, said method comprising the steps of;

providing a pair of dice each having six faces numbered one to six, establishing a first wager to each player at a first group of dice numbers 7 and 11;

establishing a second wager to each player at a second group of dice numbers 2, 3 and 12;

establishing a third wager to each player at a third group of dice numbers 4, 5, 6, 8, 9 and 10;

playing a game of chance through a round to determine a player winner; and designating a player winner with a predetermined win to roll the dice in pursuit of winning a wager by matching the rolled dice number to one of the numbers in at least one group upon which a wager was placed.

2. A method as set forth in claim 1 further defined as establishing the first group of dice numbers at first odds, establishing the second group of dice numbers at second odds, establishing the third group of dice numbers at third odds, the first and second and third odds all being different from one another.

3. A method as set forth in claim 2 including accumulating the wagers into an accumulated pot without payout from round to round of the game of chance until a player becomes a qualified player by having a predetermined win to thereby qualify to roll the dice for at least a portion of the accumulated pot.

4. A method as set forth in claim 2 including accumulating the first wagers into a first accumulated pot without payout from round to round of the game of chance until a player becomes a qualified player by having a predetermined win to thereby qualify to roll the dice for at least a portion of the first accumulated pot, accumulating the second wagers into a second accumulated pot without payout from round to round of the game of chance until a player becomes a qualified player by having a predetermined win to thereby qualify to roll the dice for at least a portion of the second accumulated pot, accumulating the third wagers into a third accumulated pot without payout from round to round of the game of chance until a player becomes a qualified player by having a predetermined win to thereby qualify to roll the dice for at least a portion of the third accumulated pot, paying out at least a portion of the first accumulated pot to the winning qualified player in response the dice numbers resulting from the roll of the dice matching one of the numbers 7 and 11 in the first group, paying out at least a portion of the second accumulated pot to the winning qualified player in response the dice numbers resulting from the roll of the dice matching one of the numbers 2, 3 and 12 in the second group, paying out at least a portion of the third accumulated pot to the winning qualified player in response the dice numbers resulting from the roll of the dice matching one of the numbers 4, 5, 6,8, 9 and 10 in the third group.

5. A method of combining the play of a game of chance and craps based upon two dice, said method comprising the steps of;

presenting a first group of dice numbers 7 and 11 at first odds based upon the roll of two dice;

presenting a second group of dice numbers 2, 3 and 12 at second odds based upon the roll of two dice;

presenting a third group of dice numbers 4, 5, 6, 8, 9 and 10 at third odds based upon the roll of two dice;

establishing an accumulative pot wager for each player on one or more of the groups;

playing a game of chance through a round to determine a player winner;

accumulating all of the accumulated pot wagers into at least one accumulated pot without payout from round to round of the game of chance until a player winner becomes a qualified player by having a predetermined win to thereby qualify to roll the dice for at least a portion of the accumulated pot;

a pair of dice to roll;

rolling the dice by the qualified player; and paying out a portion of the accumulated pot to the qualified player in response to the pot wager by the qualified player being on the group of numbers which match the numbers from the roll of dice.

* * * * *